US012631104B2

(12) United States Patent
Greenlee et al.

(10) Patent No.: US 12,631,104 B2
(45) **Date of Patent: *May 19, 2026**

(54) FRAC DART

(71) Applicant: Nine Downhole Technologies, LLC, Houston, TX (US)

(72) Inventors: Donald R. Greenlee, Houston, TX (US); Brian Oligschlaeger, Houston, TX (US); Jon Greenlee, Houston, TX (US)

(73) Assignee: NINE DOWNHOLE TECHNOLOGIES, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/229,662

(22) Filed: Jun. 5, 2025

(65) Prior Publication Data

US 2026/0092514 A1 Apr. 2, 2026

Related U.S. Application Data

(63) Continuation of application No. 18/903,446, filed on Oct. 1, 2024.

(51) Int. Cl.
*E21B 43/26* (2006.01)
*E21B 33/12* (2006.01)

(52) U.S. Cl.
CPC ..... *E21B 43/2607* (2020.05); *E21B 33/1208* (2013.01)

(58) Field of Classification Search
CPC .... E21B 23/0413; E21B 34/142; E21B 43/25; E21B 43/26; E21B 43/2607
See application file for complete search history.

(56) References Cited

U.S. PATENT DOCUMENTS

| | | | | |
|---|---|---|---|---|
| 11,193,352 | B2 | 12/2021 | Saraya | |
| 11,555,377 | B2 | 1/2023 | Lo | |
| 11,846,171 | B2 | 12/2023 | Lo et al. | |
| 11,891,877 | B1 | 2/2024 | Crews et al. | |
| 11,933,132 | B1 | 3/2024 | Shkurti et al. | |
| 2016/0326833 | A1* | 11/2016 | Luke | E21B 34/08 |
| 2018/0045014 | A1* | 2/2018 | Larisey | E21B 33/12 |
| 2021/0404285 | A1 | 12/2021 | Reyes Villegas et al. | |
| 2023/0340867 | A1 | 10/2023 | Lo et al. | |
| 2023/0399931 | A1 | 12/2023 | Lo et al. | |
| 2024/0151117 | A1 | 5/2024 | Crews et al. | |
| 2025/0341145 | A1* | 11/2025 | Coronado | E21B 33/12 |

* cited by examiner

*Primary Examiner* — Kristyn A Hall
(74) *Attorney, Agent, or Firm* — Morgan, Lewis & Bockius LLP

(57) ABSTRACT

A fracturing dart configured to seal the internal bore of a fracturing plug within a wellbore may comprise a body with a lower tapered section, a central shoulder section, and an upper cylindrical section. The fracturing dart may also comprise a first sealing assembly disposed on the lower tapered portion of the body and configured to engage an inner surface of the internal bore of the fracturing plug. The fracturing dart may also comprise a second sealing assembly disposed proximate to the central shoulder section and configured to engage a seat formed in the internal bore. The fracturing dart may also comprise one or more shear pins that engage the upper cylindrical section of the body and are configured to shear upon the application of a predetermined force in a downhole direction within the wellbore.

8 Claims, 4 Drawing Sheets

FRAC DART

TECHNICAL FIELD

The present disclosure relates generally to downhole fracturing operations, and more particularly, to a dart used to seal the passage through a fracturing plug (interchangeably referred to as a "frac plug"), which can be expelled from the plug using differential pressure.

BACKGROUND

In the oil and gas field, once a well is drilled to a desired depth relative to the surface and the casing protecting the wellbore has been installed and cemented in place, the wellbore needs to be fluidly connected to the subterranean formation that holds the oil and/or gas. This process of connecting the wellbore to the subterranean formation may include a step of plugging the well with a plug, a step of perforating the casing with a perforating gun such that various channels are formed to fluidly connect the subterranean formations to the inside of the casing, a step of removing the perforating gun from the perforated stage, and a step of fracturing the various channels in that stage.

The above operations may be repeated multiple times for perforating and/or fracturing the casing at multiple locations, corresponding to different stages of the well. Note that in this case, multiple plugs may be used for isolating the respective stages from each other during the perforating phase and/or fracturing phase. These completion operations that involve the plug-and-perf multistage fracturing method use plural plugs to isolate each phase. Each plug is pumped downhole with water and set in place to isolate the stages. The plugs ensure that the fracturing fluids are directed into a specific stage.

A frac plug generally includes slip rings and a sealing element, configured such that pressure exerted by a setting tool causes the slip rings and sealing element to radially expand such that the sealing element seals against the casing and the slip rings are separated into pieces which are forced to press radially against the casing the secure the plug in place. A frac plug will also generally include an internal bore through the mandrel, which may be sealed by releasing a ball into the well. This sealing of the internal bore allows different stages of the well to be isolated from each other, which then allows fracturing operations to be performed only in certain desired areas of the subterranean formation.

At times, it is necessary to remove the ball from the frac plug so that another perforating gun string can be pumped down or, in the case of a sand screen out, the well can be flowed back to clean out the sand and frac pumping operations can resume. The normal procedure to remove the ball from the wellbore is to try and flow it back to surface, but this has proven to be an unreliable solution. One persistent problem is that a ball may have deformed and become stuck in its seat, plugging all flow from downhole. Because a stuck or jammed frac ball acts as an isolation point for all downhole portions of the well, the only solution may be to mill out the seat, which is time-consuming, expensive, and can lead to additional complications. In addition, when the well is being flowed back, the flow may not be sufficient to force the ball all the way to the surface, in which case it will settle back in the seat of the frac plug, again blocking flow downhole.

To address certain issues with traditional frac balls, some in the industry have proposed the use of other types of flow restrictions that are intended to be less susceptible to becoming stuck or jammed in the frac plug. One such device is disclosed in U.S. Pat. No. 11,891,877. This patent describes a "valve element 142" that is initially held in place by shear pins. When a frac plug that includes the valve element is run downhole, fluid flow will eventually create a pressure differential sufficient to shear the shear pins, after which the valve element moves into contact against the valve seat to prevent further fluid flow through the plug. This design also, however, includes bypass ports formed in the outer housing. As a result, large volumes of fluid will continue flowing through the mandrel of the plug until the valve element moves into contact with the valve seat. Due to this substantial fluid flow, the pressure differential may be so great that, when the shear pins are sheared and the valve element moves downhole, that movement occurs with so much force that the valve element is damaged when it contacts the valve seat. In this way, the valve element disclosed in U.S. Pat. No. 11,891,877 may suffer from some of the same drawbacks as traditional frac balls.

Therefore, what is needed is an apparatus, system or method that addresses one or more of the foregoing issues, among one or more other issues.

SUMMARY

In one embodiment, a fracturing dart may comprise a body comprising a lower tapered section, a central shoulder section, and an upper cylindrical section comprising a first groove; a first sealing assembly disposed on the lower tapered section; and a shear pin configured to engage the first groove.

In another embodiment, the fracturing dart may further comprise a second sealing assembly disposed proximate to the central shoulder section.

In another embodiment, the lower tapered section of the body may comprise a second groove and, in such embodiment, the first sealing assembly may be disposed in the second groove and may comprise an elastomeric o-ring.

In another embodiment, the second sealing assembly may also comprise an elastomeric o-ring.

In another embodiment, the central shoulder section may comprise a chamfered surface.

In another embodiment, the fracturing dart may be part of a fracturing plug assembly that also comprises a fracturing plug comprising a mandrel with an internal bore, wherein the internal bore comprises an upper section with a first diameter, a lower section with a second diameter that is smaller than the first diameter, and a seat disposed between the upper section and the lower section. In such embodiment, the fracturing dart may comprise a body comprising a lower tapered section configured to be disposed within the lower section of the internal bore, a central shoulder section configured to engage the seat, and an upper cylindrical section comprising a first groove and configured to be disposed within the upper section of the internal bore; a first sealing assembly disposed on the lower tapered section and configured to seal against an inner surface of the lower section of the internal bore; and a shear pin configured to engage the first groove.

In another embodiment, the seat may also comprise a chamfered surface.

In another embodiment, the fracturing dart may be used in conjunction with a method of sealing a fracturing plug, comprising the steps of providing a fracturing plug comprising a mandrel with an internal bore comprising a seat and inserting into the internal bore a fracturing dart in accordance with one or more of the aforementioned embodiments.

In another embodiment, the method may comprise the step of inserting the fracturing plug and fracturing dart into a wellbore comprising a casing.

In another embodiment, the method may further comprise the step of applying pressure in a first direction to shear the shear pin, such that the fracturing dart moves in the first direction; in such embodiment, the fracturing dart may further comprise a second sealing assembly disposed proximate to the central shoulder section, such that the second sealing assembly seals against the seat when the fracturing dart moves in the first direction.

In another embodiment, the method may comprise the step of applying pressure in a second direction, such that the fracturing dart moves in the second direction and is expelled from the internal bore of the mandrel.

In another embodiment, the method may comprise the step of applying pressure in the first direction, such that the fracturing dart moves to a position between the fracturing plug and the casing.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The present disclosure relates generally to downhole fracturing operations, and more particularly, to a dart used to seal the passage through a frac plug, which can be expelled from the plug using differential pressure.

Figure 1:
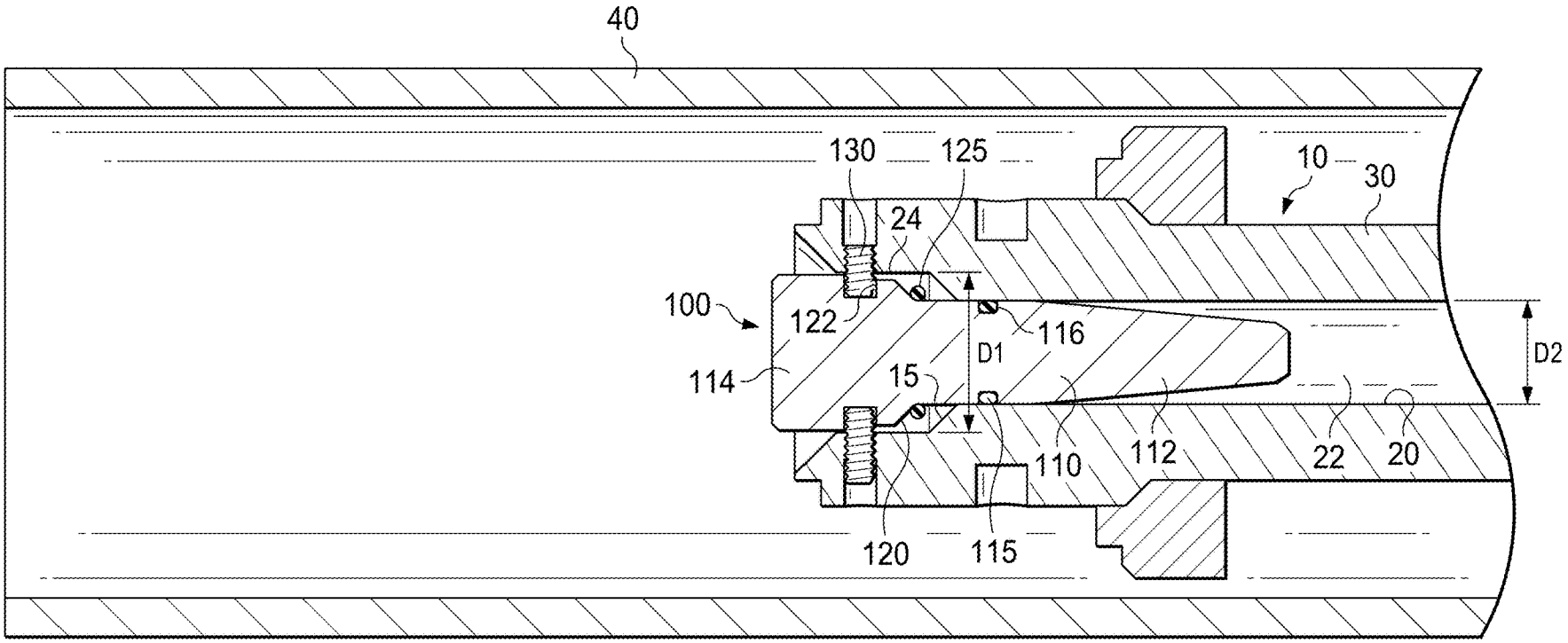
FIG. 1 is a cross-sectional view of an embodiment of the fracturing dart of the present invention, in the initial position in which the frac plug is run into the wellbore.

As shown in FIG. 1, and as will be understood by one of ordinary skill in the art, a hydraulic fracturing operation typically involves a frac plug 10. Frac plug 10 generally includes slip rings and a sealing element (not shown), configured such that pressure exerted by a setting tool causes the slip rings and sealing element to radially expand such that the sealing element seals against the casing 40 and the slip rings are separated into pieces which are forced to press radially against the casing 40 the secure the plug in place. Frac plug 10 will also generally include an internal bore 20 through a mandrel 30.

Fracturing dart (interchangeably referred to as "frac dart") 100 may comprise a body 110 that is installed in the frac plug 10 at the surface. In particular, body 110 may comprise a lower tapered section 112, a central shoulder section 120, and an upper cylindrical section 114. Correspondingly, internal bore 20 of mandrel 30 may comprise an upper section 24 with a first diameter D1, a lower section 22 with a second diameter D2 which is less than D1, and a seat 15 located between the upper and lower sections. As shown in FIG. 1, seat 15 and central shoulder section 120 may both comprise a chamfered surface with profiles configured to engage with each other. As also shown in FIG. 1, the outer diameter of upper cylindrical section 114 of body 110 is approximately equal to diameter D1 of upper section 24 of internal bore 20.

Lower tapered section 112 of body 110 is inserted into lower section 22 of internal bore 20 of mandrel 30. Disposed on an outside surface of lower tapered section 112 is sealing assembly 115. Sealing assembly 115 may comprise an elastomeric o-ring disposed within groove 116. Lower tapered section 112 of body 110 is positioned such that sealing assembly 115 sealingly engages an inner surface of lower section 22 of internal bore 20. In this way, frac dart 100 is always sealed against internal bore 20 of mandrel 30 throughout the process of running frac plug 10 into the wellbore. As a result, unlike the device disclosed in U.S. Pat. No. 11,891,877, no substantial volume of fluid flows through mandrel 30 of frac plug 10 once frac dart 100 is in place.

In addition to sealing assembly 115, frac dart 100 may include a second sealing assembly 125, which may be located near the point at which body 110 transitions from lower tapered section 112 to central shoulder section 120. Second sealing assembly 125 may also comprise an elastomeric o-ring.

As shown in FIG. 1, body 110 is initially held in place by shear pins 130. In particular, shear pins 130 extend through mandrel 30 and engage with grooves 122 formed in the outer surface of upper cylindrical section 114 of body 110.

Figure 2:
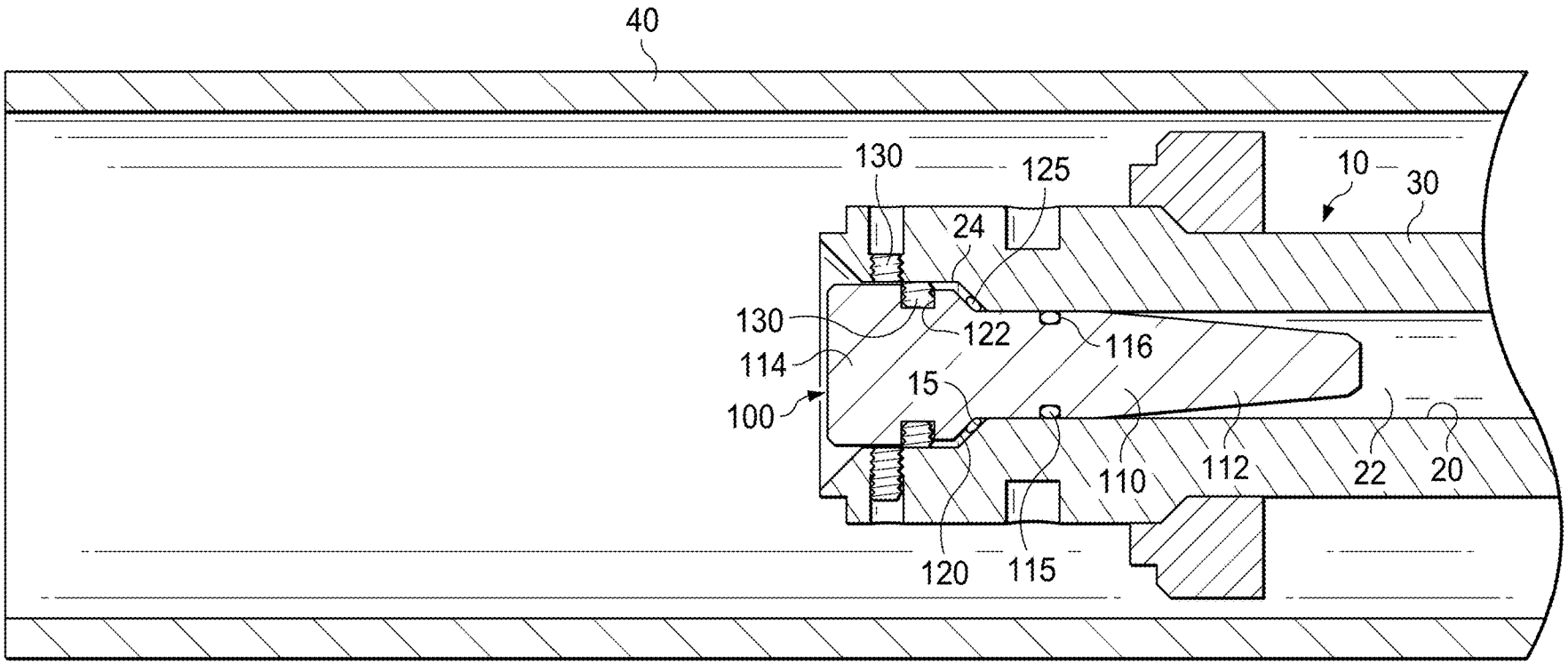
FIG. 2 is a cross-sectional view of the embodiment of the fracturing dart shown in FIG. 1, in a second position after the shear pins have been sheared.

FIG. 2 illustrates the position of body 110 after frac dart 100 has moved to its operative position. Once frac plug 10 has reached the desired location in the wellbore, it is set in a manner well known to one of ordinary skill in the art. At that point, because fluid can no longer flow between frac plug 10 and casing 40, the uphole pressure in the wellbore will increase accordingly. At a predetermined pressure, shear pins 130 will shear, allowing the uphole pressure to move frac dart 100 downhole in relation to frac plug 10. Due to the presence of sealing assembly 115, no substantial volume of fluid is flowing through internal bore 20 of frac plug 10 at the time that shear pins 130 shear. As a result, the pressure differential required for shearing should generally be lower than that required by the device disclosed in U.S. Pat. No. 11,891,877. This lower pressure differential allows for more controlled movement of frac dart 100, which reduces the possibility of frac dart 100 being damaged or deformed during the seating process described below.

The profile of central shoulder section 120 of body 110 generally corresponds with the profile of seat 15 of internal bore 20 of frac plug 10. Accordingly, when frac dart 100 moves downhole, central shoulder section 120 of body 110 will seat against seat 15 of internal bore 20. As a result of this engagement, second sealing assembly 125 is compressed between body 110 and frac plug 10, thus forming a second seal in addition to that formed by sealing assembly 115. This dual sealing feature is highly reliable and reduces the likelihood that any fluid is able to flow through internal bore 20 of frac plug 10.

Figure 3:
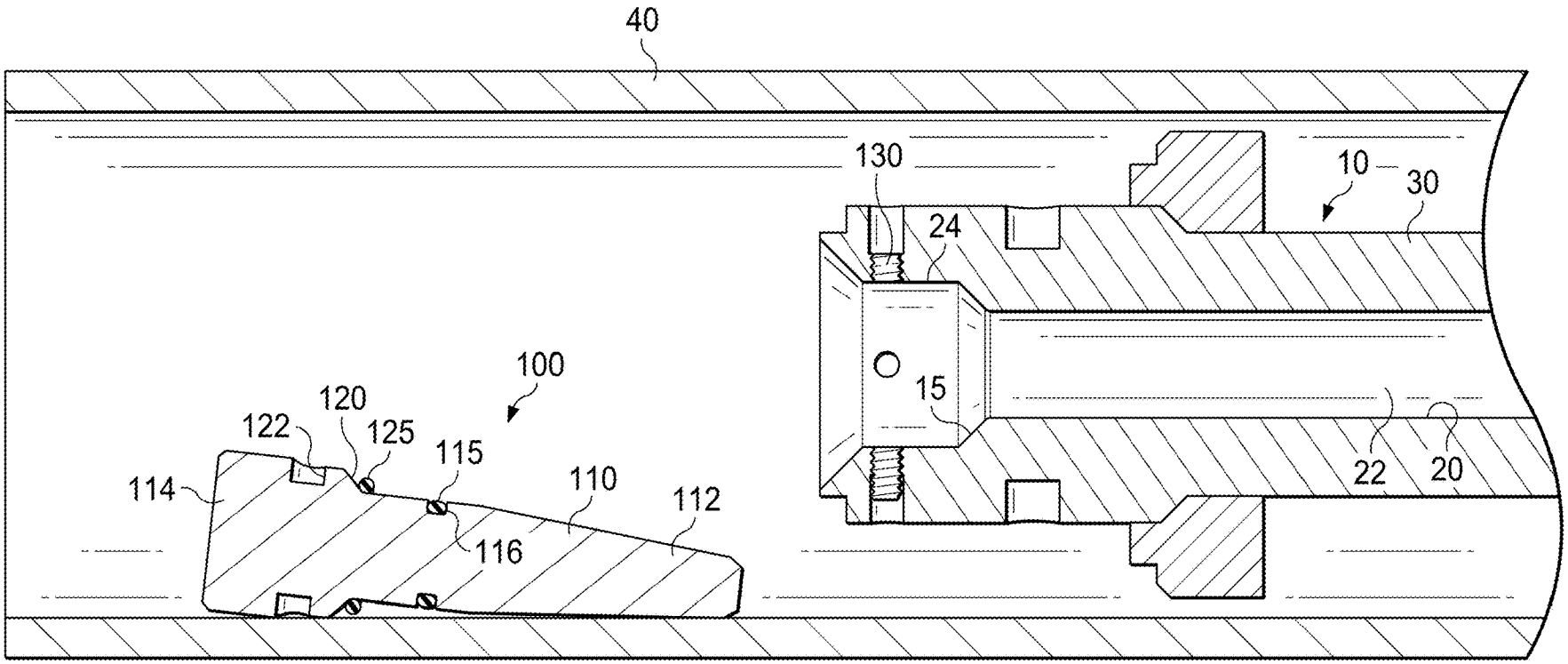
FIG. 3 is a cross-sectional view of the embodiment of the fracturing dart shown in FIG. 1, after the fracturing dart has been expelled from the frac plug.

FIG. 3 illustrates the position of frac dart 100 after it has been expelled from frac plug 10. In particular, as noted above, it is occasionally necessary to remove the flow restriction from the frac plug so that another perforating gun string can be pumped down or, in the case of a sand screen out, the well can be flowed back to clean out the sand and frac pumping operations can resume. When this occurs, because shear pins 130 are no longer holding body 110 in place, minimal pressure applied from the downhole direction can expel frac dart 100 from frac plug 10, as shown in FIG. 3.

Figure 4:
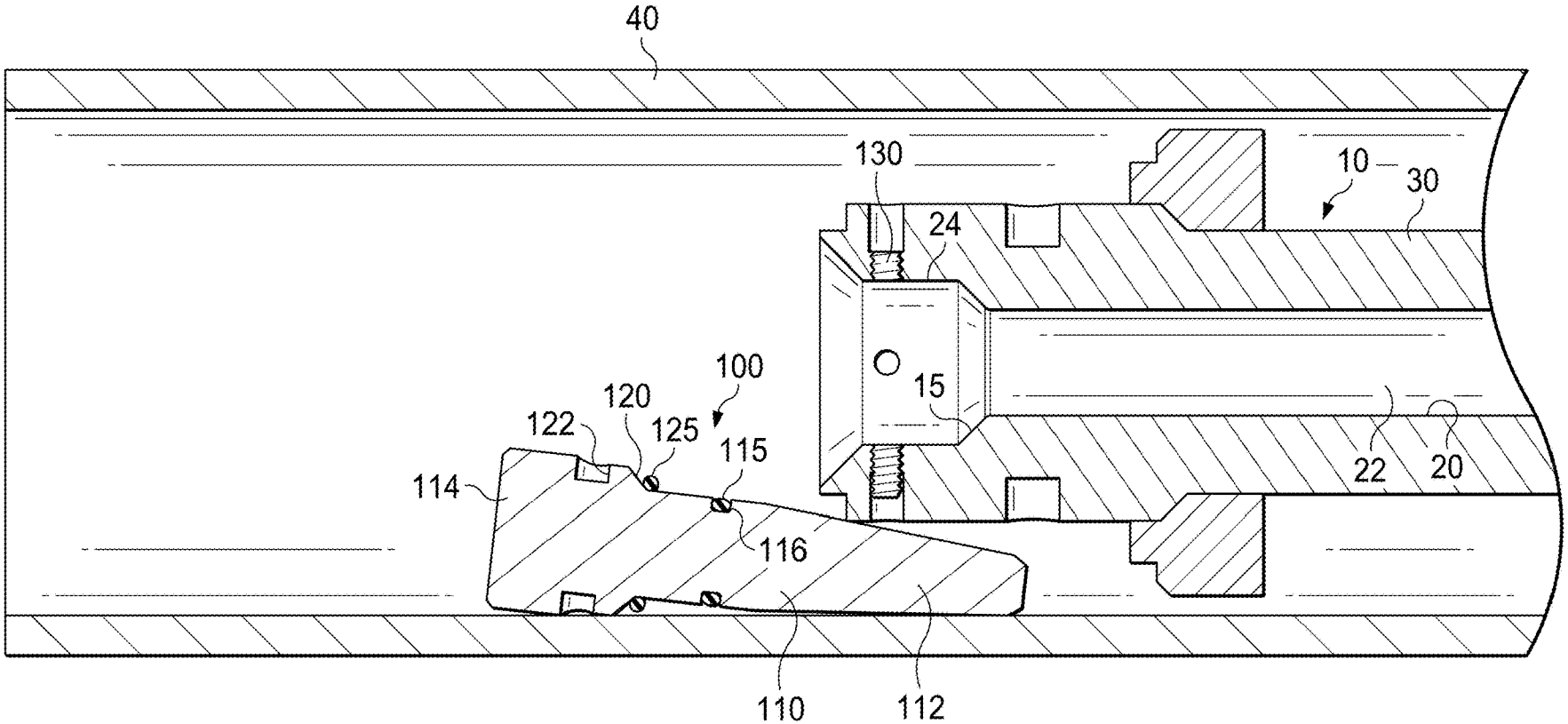
FIG. 4 is a cross-sectional view of the embodiment of the fracturing dart shown in FIG. 1, after the fracturing dart has been wedged between the casing and the mandrel of the frac plug.

If frac plug 10 is located in a vertical (or near-vertical) section of the wellbore, frac dart 100, once expelled, will move downhole by the force of gravity to wedge between frac plug 10 and casing 40. In the event that frac plug 10 is located in a horizontal section of the wellbore, frac dart 100, once expelled, will rest on the bottom surface of casing 40, as shown in FIG. 3. In this situation, pressure may be applied from the surface to cause frac dart 100 to move downhole and wedge between frac plug 10 and casing 40. In either event, once frac dart 100 is wedged between frac plug 10 and casing 40, as shown in FIG. 4, frac dart 100 is prevented from reentering internal bore 20 of frac plug 10. If it is desired to reseal internal bore 20, a traditional frac ball may be used.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A fracturing plug assembly comprising:
- a fracturing plug comprising:
  - a mandrel with an internal bore, wherein the internal bore comprises:
    - an upper section with a first diameter;
    - a lower section with a second diameter that is smaller than the first diameter; and
    - a seat disposed between the upper section and the lower section;
  - a slip ring disposed around the mandrel and configured to radially expand to engage an inner surface of a casing in which the fracturing plug is disposed; and
  - a sealing element disposed around the mandrel and configured to radially expand to engage the inner surface of the casing; and
- a fracturing dart comprising:
  - a body comprising:
    - a lower section configured to be disposed within the lower section of the internal bore;
    - a central shoulder section configured to engage the seat; and
    - an upper cylindrical section comprising a first groove and configured to be disposed within the upper section of the internal bore;
  - a first sealing assembly disposed on the lower section and configured to seal against an inner surface of the lower section of the internal bore; and
  - a shear pin configured to engage the first groove.

2. The fracturing plug assembly of claim 1, wherein the fracturing dart further comprises a second sealing assembly disposed proximate to the central shoulder section and configured to seal against the seat.

3. The fracturing plug assembly of claim 2, wherein the second sealing assembly comprises an elastomeric o-ring.

4. The fracturing plug assembly of claim 1, wherein the lower section of the body comprises a second groove.

5. The fracturing plug assembly of claim 4, wherein the first sealing assembly is disposed in the second groove.

6. The fracturing plug assembly of claim 5, wherein the first sealing assembly comprises an elastomeric o-ring.

7. The fracturing plug assembly of claim 4, wherein the lower section of the body of the fracturing dart is tapered.

8. The fracturing plug assembly of claim 1, wherein the central shoulder section comprises a first chamfered surface and the seat comprises a second chamfered surface.

* * * * *